United States Patent [19]

Hansen et al.

[11] 4,158,259

[45] Jun. 19, 1979

[54] MARBLE SHOOTING SIGHT

[76] Inventors: Egon Hansen, 1507-78th St., Kenosha, Wis. 53140; Gregg E. Hansen, 8735-44th Ave., Kenosha, Wis. 53142

[21] Appl. No.: 875,862

[22] Filed: Feb. 7, 1978

[51] Int. Cl.[2] ..... G02B 23/00

[52] U.S. Cl. ..... 33/262; 33/370

[58] Field of Search ..... 33/262, 263, 264, 265, 33/289, 333, 334, 370, 371, 372, 373; 63/1 R, 1 S

[56] References Cited

U.S. PATENT DOCUMENTS

| | | | |
|---|---|---|---|
| 967,258 | 8/1910 | Stamm | 33/373 |
| 1,041,622 | 10/1912 | Guilfoyle | 33/371 |
| 2,756,512 | 7/1956 | Pettit | 33/372 |
| 2,822,614 | 2/1958 | Susinno | 33/263 |
| 3,198,525 | 8/1965 | Smith | 33/263 |
| 3,846,918 | 11/1974 | Wehlau | 33/262 |
| 4,034,982 | 7/1977 | Rupprecht et al. | 63/1 R |

*Primary Examiner*—Richard E. Aegerter
*Assistant Examiner*—John W. Shepperd
*Attorney, Agent, or Firm*—Clarence A. O'Brien; Harvey B. Jacobson

[57] ABSTRACT

A hollow body is provided defining a pair of openings therein opening outwardly of the interior of the body in directions disposed at generally right angles relative to each other. A substantially planar light reflective surface is mounted within the body for reflecting light rays entering the body through one opening outwardly from said body through the other opening and a finger engageable support member is provided for engaging and support from a finger portion with said finger portion extending along a predetermined path relative to the support member. Mounting structure is provided for mounting the support member on the exterior of the body for adjusted angular displacement of the support member relative to the body about an axis disposed at generally right angles relative to one of said directions and said path.

7 Claims, 3 Drawing Figures

MARBLE SHOOTING SIGHT

BACKGROUND OF THE INVENTION

In the game of marbles, a player cups a marble in his bent forefinger and places the nail of his thumb behind the marble and may propel the marble from its cupped position supported from the forefinger by flicking the thumb forward. A player attempts to propel his marble into a group of marbles within a circle with sufficient force to propel one of the marbles from the circle.

Although it is possible for a person to become quite proficient in the game of marbles, many other persons do not possess the inherent abilities to enable them to become proficient without some form of aid. Accordingly, a need exists for some form of sight which may be utilized by a marble player to improve his shooting.

Various forms of sights including some of the general structural and operational features of the instant invention are disclosed in U.S. Pat. Nos. 1,486,231, 3,010,368, 3,029,517 and 3,140,339. However, these different forms of sights are not specifically adapted for use by a person playing the game of marbles.

BRIEF DESCRIPTION OF THE INVENTION

The sight of the instant invention comprises a right angle periscope-type structure including support structure mounted thereon whereby the periscope may be removably clampingly engaged with and supported from the thumb or forefinger of a person shooting marbles.

The main object of this invention is to provide a sight which will enable a person playing the game of marbles to improve his accuracy.

Another object of this invention is to provide a sight which may be utilized effectively by persons of different ages.

Still another object of this invention is to provide a sight in accordance with the preceding objects and which may be supported either from the thumb or forefinger of a person playing the game of marbles.

A final object of this invention to be specifically enumerated herein is to provide a marble shooting sight in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
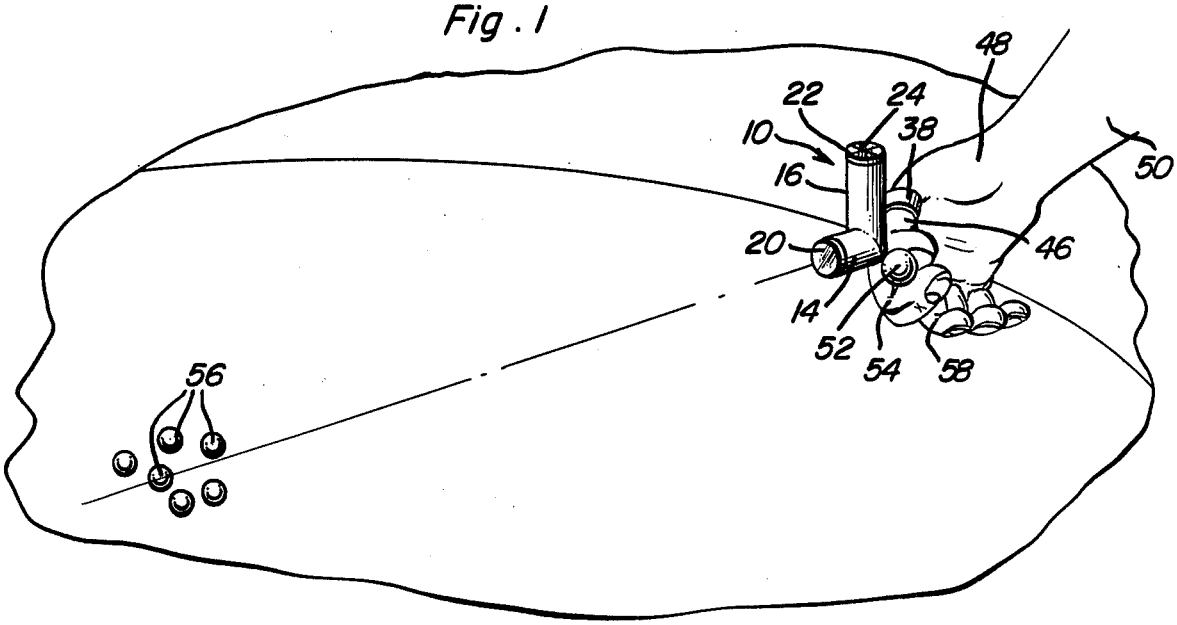
FIG. 1 is a perspective view of the marble sight of the instant invention clampingly supported from the thumb of a person playing the game of marbles.
Figure 2:
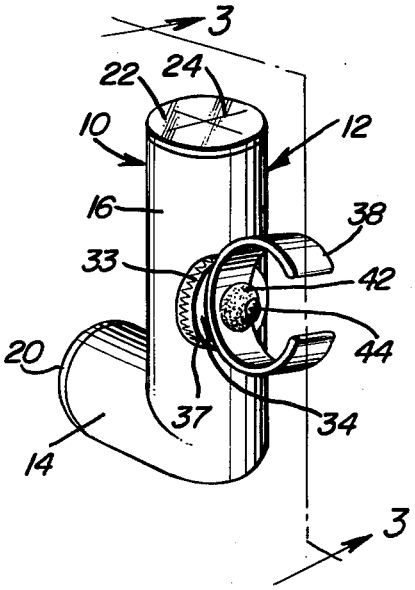
FIG. 2 is an enlarged perspective view of the marble sight as seen from the rear side thereof; and, FIG. 3 is an enlarged fragmentary vertical sectional view taken substantially upon the plane indicated by the section line 3—3 of FIG. 2.
Figure 3:
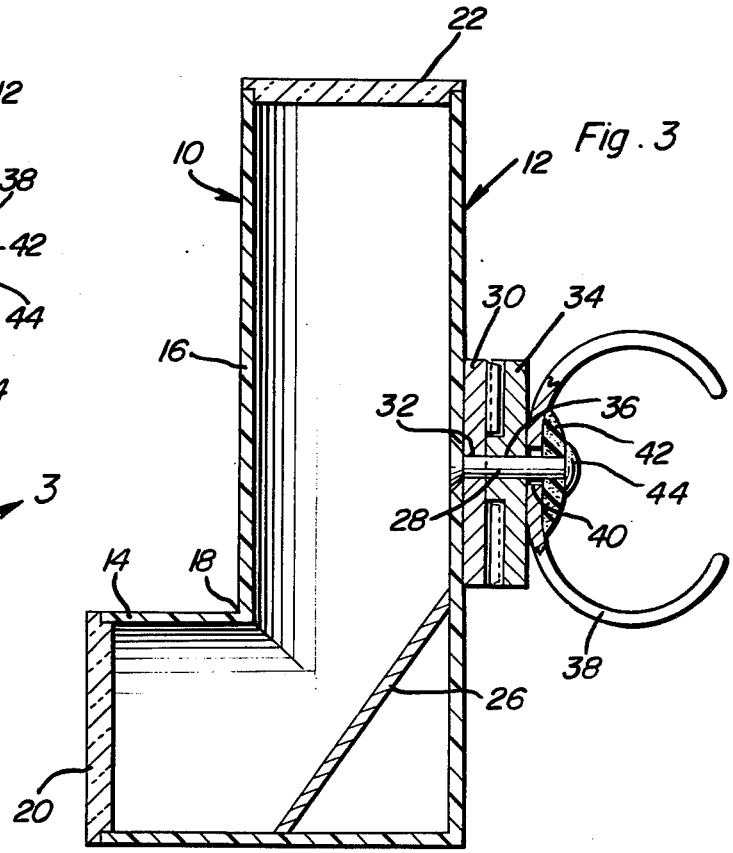

Referring now more specifically to the drawings, the numeral 10 generally designates the marble sight of the instant invention. The sight 10 includes a hollow tubular body referred to in general by the reference numeral 12 and of generally L-shaped configuration including right angularly disposed short and long legs 14 and 16. The tubular legs 14 and 16 intersect with and open into each other as at 18 and the remote ends of the legs 14 and 16 are open and are covered by transparent panels 20 and 22 secured in the open remote ends of the legs 14 and 16. The panel 22 has a recticle 24 etched therein and the interior of the body 12, at the intersection of the legs 14 and 16, has a planar light reflective panel or mirror 26 mounted therein in any convenient manner. The panel 26 is disposed at substantially 45 degrees relative to the longitudinal center lines of each of the legs 14 and 16. Accordingly, light rays entering the leg 14 of the body 12 through the panel 20 and incident upon the panel 26 are reflected longitudinally of the leg 16 and out through the transparent panel 22.

The body 12 may be constructed of any suitable material such as plastic or metal and the panels 20 and 22 may be constructed of clear plastic or glass. Further, the panel 26 may be constructed of mirrored glass or highly polished metal.

The length of the leg 16 from the panel 22 to the remote side of the leg 14 is approximately 2½ inches and the leg 14 projects outwardly from one side of the leg 16 approximately one-half inch. Further, the legs 14 and 16 are approximately three-quarters of an inch in diameter.

The side of the leg 16 opposite from the side thereof outwardly of which the leg 14 projects includes an outwardly projecting mounting shank 28 and a detent disk 30 having a central bore 32 formed therethrough is mounted on the end of the shank 28 adjacent the body 12 and is secured to the latter in any convenient manner. The disk 30 is concentric with the shank 28 and the outer side thereof includes serrations 33 arranged in a circular pattern concentric with the shank 28. The longitudinal medial portion of the shank 28 has a second detent disk 34 mounted thereon and the disk 34 is centrally apertured as at 36 and is rotatably and slidably mounted on the shank 28. The side of the disk 34 opposing the disk 30 is also provided with serrations 37 arranged in a circular pattern concentric with the bore 36 and the serrations 33 and 37 are engaged with each other to lock the disk 34 against angular displacement about the shank 28 relative to the disk 30.

A support member 38 in the form of a resilient C-shaped clamp member is provided with a central bore 40 by which the clamp member 38 is rotatably and slidably mounted on the outer end portion of the shank 28 and a resilient washer 42 is disposed on the shank 28 outwardly of the portion of the clamp member 38 having the bore 40 formed therein and secured on the shank 28 by means of a diametrically enlarged head 44 formed on the outer terminal end of the shank 28.

The washer 42 yieldingly biases the clamp member and the detent disk 34 toward the detent disk 30 whereby the serrations 37 will be meshed with the serrations 33 and the clamp member 38 is anchored relative to the detent disk 34 in any convenient manner. However, if it is desired to rotate the disk 34 on the shank 28 relative to the disk 30, the disk 34 is grasped and pulled away from the disk 30 compressing the washer 42 and thereafter rotated to the desired position after which the detent disk 34 may be released, whereupon the washer 42 will again yieldingly bias the detent disk 34 toward a position with the serrations 37 meshed with the serrations 33 and thus locking the disk 34 against angular displacement relative to the disk 30.

In operation, the clamp member 38 is clampingly engaged about the thumb portion 46 of the thumb 48 of the player 50 having a marble 52 cradled in his bent forefinger 54. The player 50 may then view the target marbles 56 through the sight 10 and thus improve his aim preparatory to flicking the marble 52 with his thumb toward the target marbles 56. Of course, the clamp member 38 may also be clampingly supported from the forefinger 54 or perhaps even the second finger 58 of the player 50, if desired, and the clamp member 38 may be adjustably rotated to the desired angularly displaced position according to the portion of the hand 48 with which the clamp member 38 is to be clampingly engaged.

The reticle 24 aids in enabling the player 50 to determine the exact position of the target marble 56 relative to the player's hand 48 and may be etched in the panel 20 rather than the panel 22, if desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A marble shooting sight including a hollow body defining a pair of openings therein opening outwardly of the interior of said body in directions disposed at generally right angles relative to each other, substantially planar light reflective means mounted within said body for reflecting light rays entering said body through said one opening outwardly from said body through the other opening, a support member defining an elongated area in which to receive a supportive finger portion with said finger portion extending along said elongated area and said support member supported from said finger portion, mounting means mounting said support member on the exterior of said body for adjusted angular displacement of said support member relative to said body about an axis disposed at generally right angles relative to one of said directions and said area, said mounting means including a mounting shank projecting outwardly from said body, said support member including a generally C-shaped clamp member having a bore formed therethrough centrally intermediate the opposite ends of the arc defined by said clamp member, the other free end portion of said shank being rotatably, and longitudinally slidably secured through said bore, said shank and bore being coaxial with said axis, said body and clamp member each including means defining alternating projections and recesses extending about said axis and seatingly engaged with each other, and means connected between said shank and said clamp member yieldingly biasing the latter toward said body.

2. The combination of claim 1 wherein said support member includes a generally C-shaped clamp member disposed in a plane generally paralleling said axis.

3. The combination of claim 1 wherein each of said openings is closed by means of a transparent panel secured thereover.

4. The combination of claim 1 wherein one of said transparent panels includes a reticle.

5. The combination of claim 1 wherein said mounting means includes means operative to releasably retain said support member in predetermined relatively angularly displaced positions relative to said body.

6. The combination of claim 1 wherein each of said openings is closed by means of a transparent panel secured thereover.

7. A marble shooting sight including a hollow body having front, rear, top and bottom sides and defining a pair of openings therein opening outwardly of the interior of said body through said front and top sides in directions disposed at generally right angles relative to each other, substantially planar light reflective means mounted within said body for reflecting light rays entering said body through one opening outwardly from said body through the other opening, a support member defining an elongated area in which to receive a supportive finger portion with said finger portion extending along said elongated area and said support member supported from said finger portion, mounting means mounting said support member on the rear side of said body for adjusted angular displacement of said support member relative to said body about an axis extending in a front-to-rear direction relative to said body and transversely through said elongated area.

* * * * *